US008636544B1

(12) United States Patent
Briant et al.

(10) Patent No.: US 8,636,544 B1
(45) Date of Patent: Jan. 28, 2014

(54) PLUG CONNECTOR AND RECEPTACLE ASSEMBLY FOR MATING WITH THE SAME

(71) Applicant: Tyco Electronics Corporation, Berwyn, PA (US)

(72) Inventors: Eric David Briant, Dillsburg, PA (US); Brian Keith McMaster, Jr., Mechanicsburg, PA (US); Daniel Lee Gorenc, Harrisburg, PA (US); John Eugene Westman, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/687,158

(22) Filed: Nov. 28, 2012

(51) Int. Cl.
*H01R 13/648* (2006.01)

(52) U.S. Cl.
USPC ..... 439/607.25

(58) Field of Classification Search
USPC ..... 439/607.25, 607.28, 607.01, 607.2, 439/607.19, 636, 79, 557, 927, 939, 108, 439/357, 358, 352, 350, 356, 355
See application file for complete search history.

(56) References Cited

U.S. PATENT DOCUMENTS 7,413,473 B2 * 8/2008 Wu ..... 439/557
7,438,596 B2 * 10/2008 Phillips ..... 439/607.01
7,445,484 B2 * 11/2008 Wu ..... 439/352
7,581,978 B1 9/2009 Briant
8,157,593 B1 * 4/2012 Sim et al. ..... 439/607.28
2009/0264002 A1 * 10/2009 Bright et al. ..... 439/271

OTHER PUBLICATIONS

Tyco Electronics Corporation; Mini Multi-Lane High Speed Interconnects & Cable Assemblies; Berwyn PA; 2010.
Tyco Electronics Corporation; Mini SAS HD External Receptacle (Connector and Cage Assembly); Berwyn, PA; Feb. 3, 2012.
Tyco Electronics Corporation; Mini SAS HD Interconnects; Berwyn, PA; 2012.

* cited by examiner

*Primary Examiner* — Edwin A. Leon

(57) ABSTRACT

Plug assembly including first and second plug connectors that are configured to be stacked with respect to each other. Each of the first and second plug connectors has a mating side that extends between leading and trailing ends along a plug axis. The mating side includes an attachment area and an exposed area that are laterally adjacent to each other. Each of the first and second plug connectors also has an electromagnetic interference (EMI) shield section coupled to the mating side at the attachment area. The mating sides of the first and second plug connectors interface with each other when the first and second plug connectors are stacked. The EMI shield section of the first plug connector engages the mating side of the second plug connector at the exposed area. The EMI shield section of the second plug connector engages the other mating side at the exposed area.

20 Claims, 8 Drawing Sheets

PLUG CONNECTOR AND RECEPTACLE ASSEMBLY FOR MATING WITH THE SAME

BACKGROUND

The subject matter herein relates generally to connector assemblies that include a plug connector and a receptacle assembly that receives and communicatively engages the plug connector.

Industry demands for optical and electrical connector assemblies may include, among other things, a greater density of signal pathways, higher data rates, smaller size, greater flexibility, and/or suitable electromagnetic interference (EMI) shielding. In one type of an electrical connector assembly, a plug connector, which may also be referred to as a transceiver or interconnect, is inserted into a cavity of a receptacle assembly. The plug connector includes a leading end having a card edge with an array of contact pads. The card edge is received by an internal slot of the receptacle assembly that is disposed within the cavity. The slot includes opposing rows of resilient contacts that receive the card edge therebetween. Each row of resilient contacts engages a different side of the card edge.

The receptacle assembly described above may have different configurations. For example, one configuration may include only a single port for receiving a single plug connector, and another configuration may include multiple ports that are stacked relative to each other in which each port receives a separate plug connector. The multi-stacked configuration may have a single cage or housing that defines each of the ports in which adjacent ports are separated by a wall of the cage. Yet another configuration may include a single port that has multiple internal slots disposed therein that are stacked relative to each other.

However, connector assemblies that include such receptacle configurations typically lack flexibility. More specifically, different receptacle configurations may require unique plug connector designs that are not suitable for other receptacle configurations. For example, if a single port of a receptacle assembly has multiple internal slots, the corresponding plug connector has an equal number of card edges that are appropriately stacked relative to each other for engaging the slots. Different configurations of plug connectors, such as those having a single card edge, may be incapable of being inserted into and communicatively engaging only one of the slots of the multi-slot receptacle assembly. In addition, if a plug connector having a single card edge were inserted into a multi-slot receptacle assembly, only a portion of the port would be occupied while another portion remained unoccupied. EMI problems may arise under such circumstances.

The problems described above are not unique to electrical connector assemblies. For example, plug connectors of optical connector assemblies may have leading ends that are specifically configured to engage only a single slot or, in other configurations, multiple slots of a receptacle assembly.

Accordingly, there is a need for a connector assembly having a plug connector and a receptacle assembly in which the receptacle assembly is capable of receiving more than one plug connector through a single port.

BRIEF DESCRIPTION

In one embodiment, a plug assembly is provided that includes first and second plug connectors that are configured to be stacked with respect to each other. Each of the first and second plug connectors has leading and trailing ends and a plug axis extending therebetween. Each of the first and second plug connectors also includes a mating side that extends between the leading and trailing ends along the plug axis. The mating side includes an attachment area and an exposed area that are laterally adjacent to each other. Each of the first and second plug connectors also has an electromagnetic interference (EMI) shield section coupled to the mating side at the attachment area. The mating sides of the first and second plug connectors interface with each other when the first and second plug connectors are stacked with respect to each other. The EMI shield section of the first plug connector engages the mating side of the second plug connector at the exposed area of the mating side. The EMI shield section of the second plug connector engages the mating side of the first plug connector at the exposed area of the mating side.

In some embodiments, the EMI shield sections of the first and second plug connectors may permit the first and second plug connectors to slide alongside each other parallel to the corresponding plug axes while the EMI shield sections are engaged to the mating sides. In some embodiments, the first and second plug connectors have identical structures such that the EMI shield sections are positioned immediately adjacent to each other when one of the first or second plug connectors is inverted relative to the other of the first or second plug connectors and the mating sides of the first and second plug connectors interface with each other.

In another embodiment, a plug connector is provided that includes a plug body having leading and trailing ends and a plug axis extending therebetween. The plug body includes a plurality of sides that extend between the leading and trailing ends along the plug axis. The plurality of sides includes opposite first and second longitudinal sides and a mating side that extends between the first and second longitudinal sides. The mating side includes an attachment area and an exposed area that are laterally adjacent to each other between the first and second longitudinal sides. The plug connector also includes an electromagnetic interference (EMI) shield section that is coupled to the mating side at the attachment area. The exposed area of the mating side is electrically conductive and configured to engage a different EMI element.

In yet another embodiment, a receptacle assembly is provided that includes an assembly housing having front and back ends and a longitudinal axis extending therebetween. The assembly housing includes a plug cavity having a receiving port at the front end. The plug cavity is defined by a pair of interior surfaces of the assembly housing that oppose each other. Each of the interior surfaces includes a guide element that extends along the longitudinal axis. The guide elements generally divide a volume of the plug cavity into separate first and second passageways. The receptacle assembly also includes first and second communication conductors that are disposed in the plug cavity. The receiving port is configured to receive first and second plug connectors within the first and second passageways, respectively. The guide elements guide the first and second plug connectors along the longitudinal axis to engage the first and second communication conductors, respectively.

In yet another embodiment, a connector assembly is provided that includes a receptacle assembly and at least one plug connector that is configured to mate with the receptacle assembly. The receptacle assembly may include an assembly housing having front and back ends and a longitudinal axis extending therebetween. The assembly housing includes a plug cavity having a receiving port at the front end. The assembly housing includes guide elements disposed in the plug cavity that generally separate a volume of the plug cavity into first and second passageways. The plug connector has leading and trailing ends and a plug axis extending therebetween. The plug connector includes a mating side that extends between the leading and trailing ends along the plug axis. The mating side includes an attachment area and an exposed area that are laterally adjacent to each other. The plug connector also includes an electromagnetic interference (EMI) shield section that is coupled to the mating side at the attachment area. The exposed area of the mating side is electrically conductive and configured to engage a different EMI element. The receiving port of the receptacle assembly is configured to receive the plug connector. The guide elements guide the plug connector along the longitudinal axis within the first passageway to engage a communication conductor therein. The mating side faces the second passageway when the plug connector is disposed in the plug cavity.

DETAILED DESCRIPTION

Figure 1:
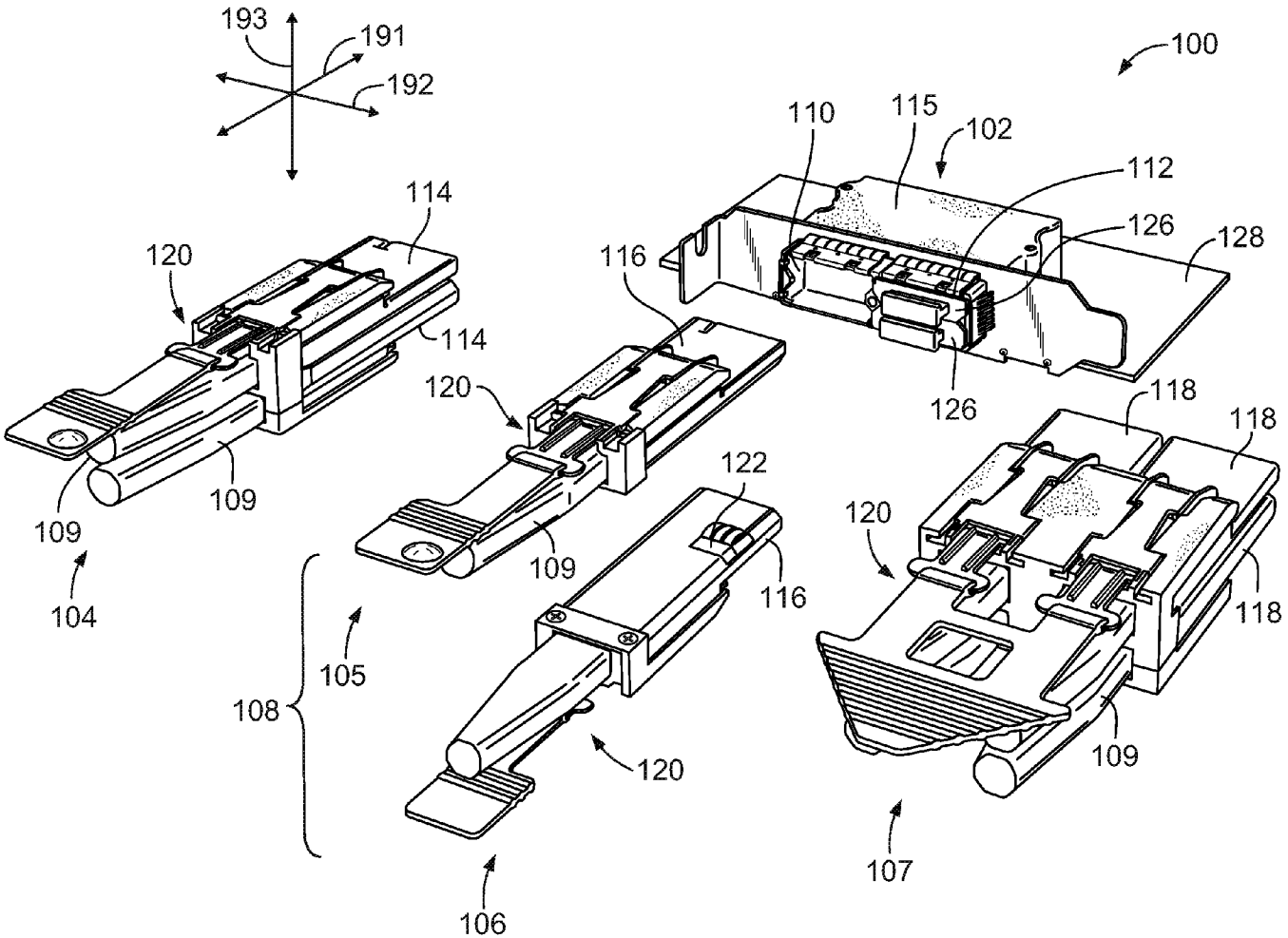
FIG. 1 is a perspective view of a connector assembly in accordance with one embodiment.

FIG. 1 is a perspective view of a connector assembly 100 formed in accordance with one embodiment. The various components of the connector assembly 100 are oriented with respect to mutually perpendicular axes 191-193 including an insertion axis 191, a lateral axis 192, and an orientation axis 193. The connector assembly 100 includes a receptacle assembly 102 that is configured to mate with a plurality of different types of plug connectors 104-107, including a plug assembly 108 that comprises the plug connectors 105 and 106 stacked with respect to each other. The plug connectors 105 and 106 may be inserted into the receptacle assembly 102 separately one after the other or inserted together as single module. As shown, each of the plug connectors 104-107 may include one or more latch assemblies 120 that may be actuated to release the plug connectors 104-107 and remove the plug connectors 104-107 from the receptacle assembly 102.

The plug connectors 104-107 may be part of, for example, a common product line of plug connectors that are capable of high speed data rates (e.g., 6 Gbps or more) and are suitable for use in various applications, such as host bus adapters, redundant arrays of inexpensive disks (RAIDs), workstations, rack-mount servers, computers, and storage racks. In the illustrated embodiment, each of the plug connectors 104-107 includes multiple lanes in which each lane has a differential pair of conductors for sending data signals and a differential pair for receiving data signals. The plug connectors 104-107, however, may have other configurations for transmitting data signals. In some embodiments, the plug connectors 104-107 may be described as transceivers.

Each of the plug connectors 104-107 is communicatively coupled to at least one cable 109. The cable 109 may include electrical conductors or optical conductors (e.g., optical fiber lines). For electrical embodiments, the plug connectors 104-107 may transmit electrical signals therethrough. For optical embodiments, the plug connectors 104-107 may include a signal converter (not shown) that is configured to receive data signals of a first signal form and convert the data signals into a different second signal form (e.g., convert optical signals into electrical signals or electrical signals into optical signals). Alternatively, the plug connectors 104-107 may not convert the optical signals into electrical signals and, instead, may transmit the optical signals directly to the receptacle assembly 102 or receive optical signals directly from the receptacle assembly 102.

The receptacle assembly 102 includes an assembly housing 115 that is configured to be mounted to a circuit board 128. As shown, the receptacle assembly 102 includes first and second receiving ports 110, 112. The receiving port 110 is unoccupied and configured to receive a corresponding plug connector. The receiving port 112, on the other hand, includes a pair of dust plugs 126. In the illustrated embodiment, the receiving ports 110, 112 are arranged side-by-side along the lateral axis 192. In alternative embodiments, the receiving ports 110, 112 may be stacked along the orientation axis 193. Although the receptacle assembly 102 shows two receiving ports 110, 112, other embodiments may include only a single receiving port or more than two receiving ports.

Each of the plug connectors 104-107 is configured to mate with the receptacle assembly 102. More specifically, each of the plug connectors 104-107 is configured to be inserted through one or both of the receiving ports 110, 112 to engage one or more receptacle connectors (described below) disposed therein. The plug connector 104 includes a plurality of plug bodies (or body portions) 114 in which each of the plug bodies 114 encloses a corresponding card connector (not shown). The plug connector 104 may be characterized as having a multi-plug or dual-plug configuration. In the illustrated embodiment, the plug bodies 114 are part of a common housing structure (i.e., the plug bodies 114 are a single continuous structure). In alternative embodiments, however, the plug bodies may be separate structures that are coupled together to construct the plug connector 104.

The plug connector 105 includes a single plug body 116 that encloses a corresponding card connector (not shown). The plug connector 106 includes a single plug body 116 that encloses a corresponding card connector 250 (shown in FIG. 2). The plug connector 106 also includes an electromagnetic interference (EMI) shield section 122 that is coupled to the plug body 116. Each of the plug connectors 105, 106 may be characterized as having a single plug configuration, but the plug connectors 105, 106 may be combined in the plug assembly 108 to form a dual-plug configuration. The plug connector 107 is similar to the plug connector 104, but includes four plug bodies (or body portions) 118 of which only three are shown. Each of the plug bodies 118 may enclose a corresponding card connector (not shown). The plug connector 107 may be characterized as having a multi-plug or quad-plug configuration. Similar to the plug bodies 114 of the plug connector 104, the plug bodies 118 are part of a common housing structure (i.e., the plug bodies 118 may be a single continuous structure). In alternative embodiments, however, the plug bodies 118 may be separate structures that are coupled together to construct the plug connector 107. Accordingly, the receptacle assembly 102 may engage and communicatively couple with different structural configurations of plug connectors.

Figure 2:
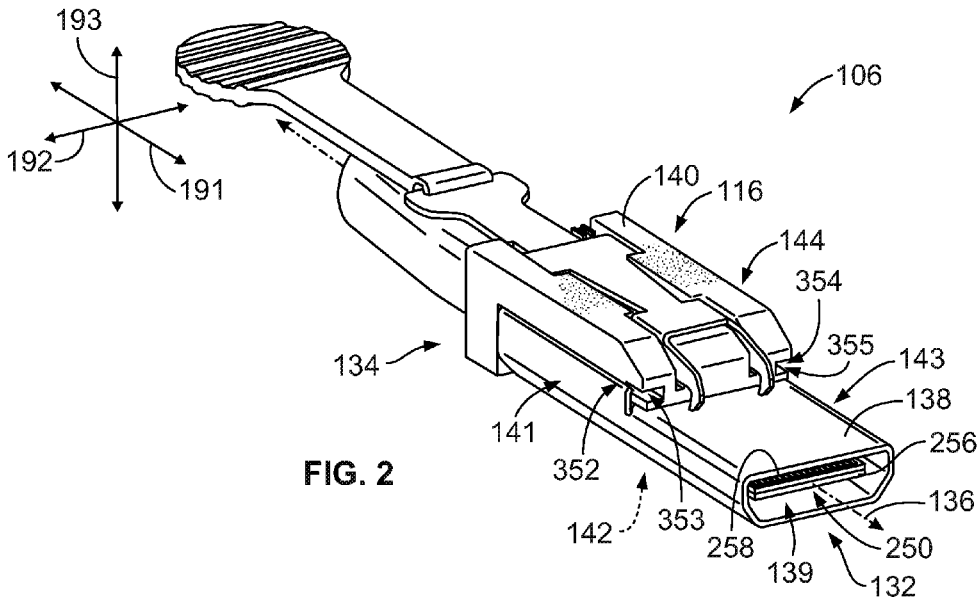
FIG. 2 is a front perspective view of a plug connector formed in accordance with one embodiment that may be used by the connector assembly of FIG. 1.
Figure 3:
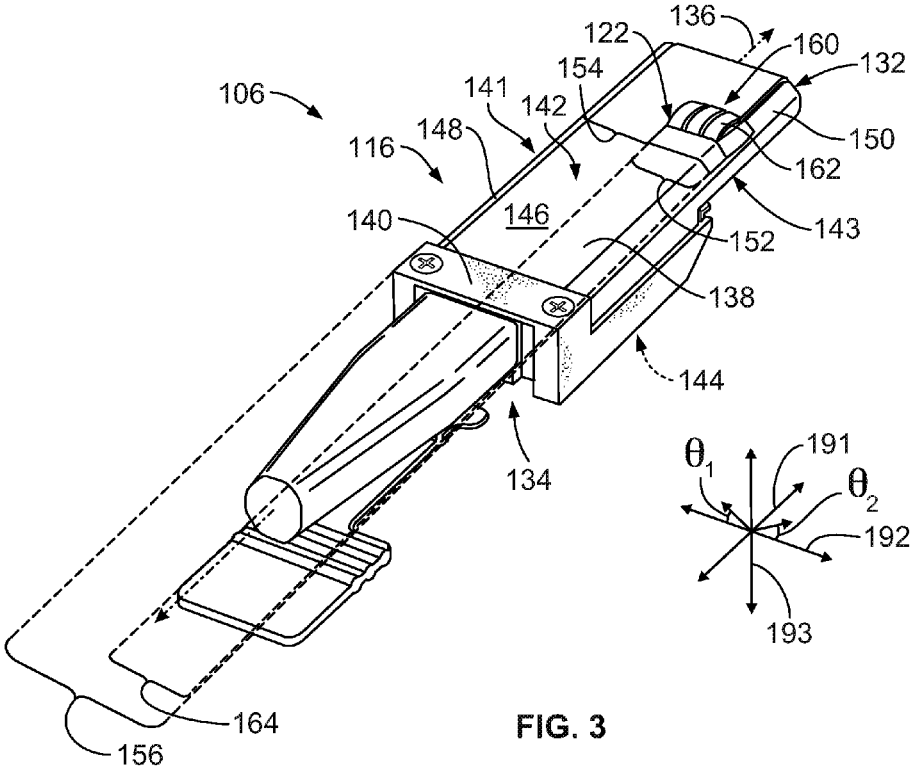
FIG. 3 is a rear perspective view of the plug connector in an inverted orientation with respect to the orientation shown in FIG. 2.

FIGS. 2 and 3 are perspective views of the plug connector 106. In particular, FIG. 2 is a front perspective view of the plug connector 106, and FIG. 3 is a rear perspective view of the plug connector 106 in an inverted orientation with respect to the orientation shown in FIG. 2. In some embodiments, the plug connector 105 (FIG. 1) and the plug connector 106 may be identical or have similar structures. Thus, although the following description is with specific reference to the plug connector 106, the description may be similarly applied to the plug connector 105.

As shown in FIGS. 2 and 3, the plug body 116 of the plug connector 106 has leading and trailing ends 132, 134 and a plug axis 136 extending therebetween. When the plug connector 106 is inserted into the receptacle assembly 102 (FIG. 1), the plug axis 136 is parallel to the insertion axis 191. In the illustrated embodiment, the plug body 116 includes a plurality of sides 141-144 that extend between the leading and trailing ends 132, 134 along the plug axis 136. The plurality of sides 141-144 may include opposite first and second longitudinal sides or edges 141, 143 and a mating side 142 that extends between the first and second longitudinal sides 141, 143. The plug body 116 may also include an exterior or non-mating side 144 that extends between the first and second longitudinal sides 141, 143. The mating and exterior sides 142, 144 face in opposite directions along the orientation axis 193. The longitudinal sides 141, 143 face in opposite directions along the lateral axis 192. A plug width 156 (shown in FIG. 3) of the plug body 116 may be measured between the first and second longitudinal sides 141, 143.

The plug body 116 includes a housing shell 138 and a base portion 140. Each of the sides 141-144 may include portions of the housing shell 138 and the base portion 140. The housing shell 138 and the base portion 140 may be separate components that are secured to each other when the plug body 116 is constructed. By way of example, the housing shell 138 may be stamped and formed from conductive sheet material and the base portion 140 may be die-cast or molded.

As shown in FIG. 2, the base portion 140 includes shell channels 352, 354 that extend parallel to the plug axis 136 and through the base portion 140. The shell channels 352, 354 have respective inlets 353, 355 that open toward the leading end 132 in a direction along the plug axis 136. Also shown in FIG. 2, the housing shell 138 may define a card cavity 139 where the card connector 250 is disposed. The card connector 250 includes a card edge 256 having a plurality of contacts 258 thereon. The card connector 250 may be held within the card cavity 139 so that, for instance, the card edge 256 is properly located and does not move excessively during engagement. For example, the card connector 250 may be held by a dielectric material (not shown) that is molded around a portion of the card connector 250 within the card cavity 139.

With respect to FIG. 3, the housing shell 138 may include a majority of the mating side 142. In the illustrated embodiment, the mating side 142 may include a planar surface 146 of the housing shell 138 that faces in a direction along the orientation axis 193 and may also include first and second inclined surfaces 148, 150 of the housing shell 138. The planar surface 146 extends between and joins the first and second inclined surfaces 148, 150. As shown, the planar surface 146 may extend parallel to a plane defined by the insertion and lateral axes 191, 192. The inclined surfaces 148, 150 may face at non-orthogonal angles $\theta_1$, $\theta_2$, respectively, with respect to the plane defined by the insertion and lateral axes 191, 192.

As shown in FIG. 3, the mating side 142 includes an attachment area 152 and an exposed area 154 that are laterally adjacent to each other along the plug width 156. More specifically, the attachment and exposed areas 152, 154 may include portions of the planar surface 146. The attachment and exposed areas 152, 154 may be directly adjacent to each other (e.g., the planar surface 146 extends continuously from the attachment area 152 directly to the exposed area 154). In the illustrated embodiment, the attachment area 152 also includes a portion of the inclined surface 150, and the exposed area 154 also includes a portion of the inclined surface 148. The exposed area 154 may represent a portion of the plug connector 106 that directly engages another shield section of either (a) another plug connector (e.g., the plug connector 105 in FIG. 1) or (b) a dust plug, such as the dust plug 126 (FIG. 1).

The EMI shield section 122 may be coupled to the mating side 142 at the attachment area 152. The exposed area 154 of the mating side 142 is not directly attached to an EMI shield section or other EMI element of the plug connector 106. However, like the attachment area 152, the exposed area 154 may be electrically conductive and configured to engage a different EMI element from either the plug connector 105 or from one of the dust plugs 126.

The EMI shield section 122 includes a resilient member 160 that projects away from the mating side 142. The resilient member 160 may be flexible and configured to be deflected toward the mating side 142. In particular embodiments, the resilient member 160 has a curved contour that extends away from the mating side 142 and curves back toward the mating side 142. As one example, the resilient member 160 may include at least one spring finger 162.

As shown in FIG. 3, the EMI shield section 122 has a section width 164 that extends from the longitudinal side 143 toward the longitudinal side 141. The section width 164 may be dimensioned to be not greater than about half the plug width 156. In particular embodiments, the EMI shield section 122 is shaped to be secured to the planar surface 146 and to the inclined surface 150. The portion of the EMI shield section 122 that is attached to the planar surface 146 has a plurality of spring fingers 162 and the portion of the EMI shield section 122 that is attached to the inclined surface 150 has a single spring finger 162. However, other configurations may be used in other embodiments.

Figure 4:
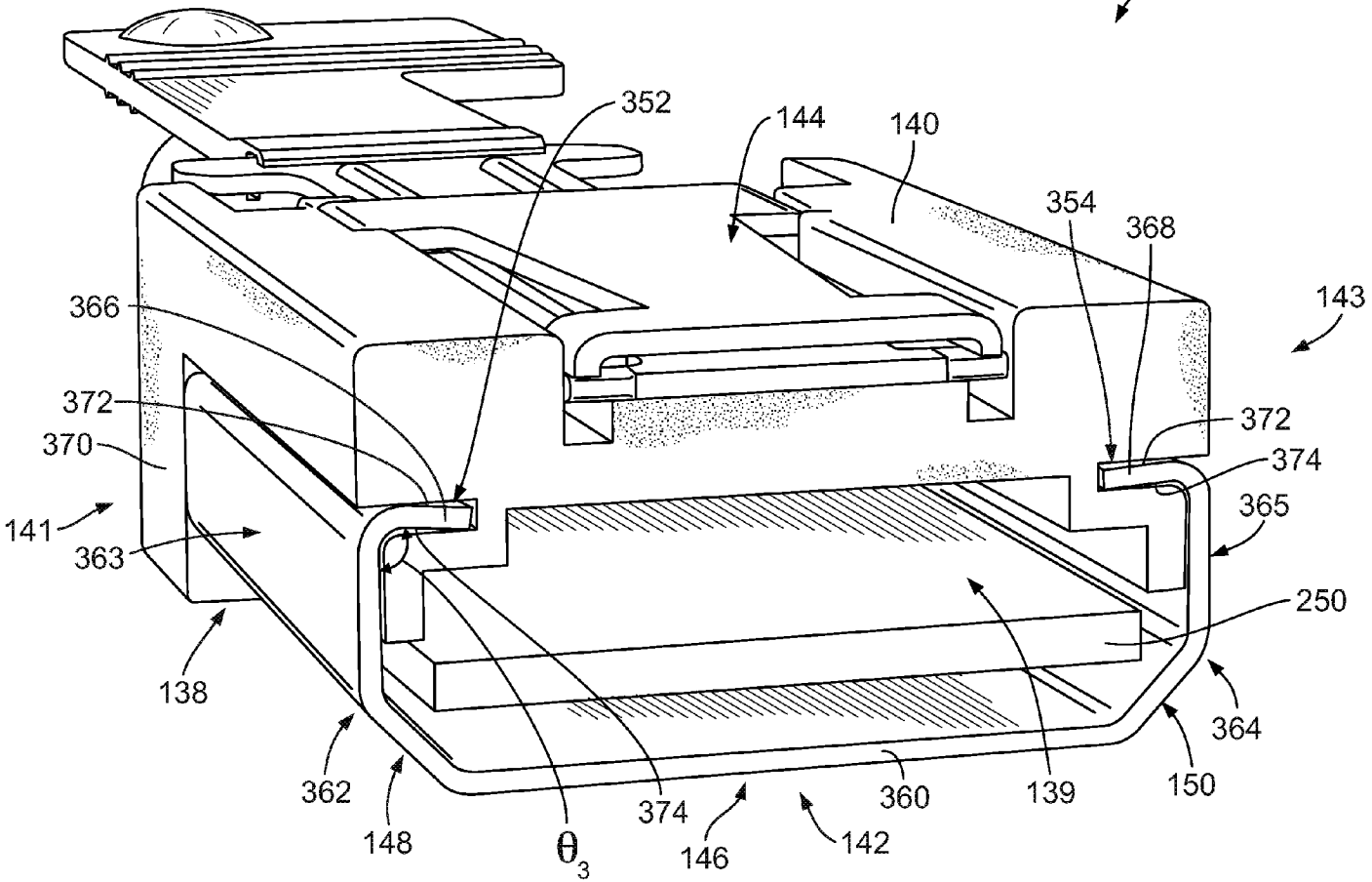
FIG. 4 illustrates a cross-section of the plug connector shown in FIG. 2.

FIG. 4 illustrates a front perspective cross-section of the plug connector 106. As shown, the housing shell 138 and the base portion 140 are coupled together to define the card cavity 139. The card connector 250 is located in the card cavity 139. A portion of the exterior side 144 is shown, which extends between the longitudinal sides 141, 143 and is opposite the mating side 142. In the illustrated embodiment, the shell channels 352, 354 are open along the longitudinal sides 141, 143, respectively. Each of the shell channels 352, 354 is defined by opposite sidewalls 372, 374.

The housing shell 138 may be shaped to enclose or surround the card connector 250. For example, the housing shell 138 may include a board section 360 and first and second legs 362, 364 that are joined by the board section 360. As shown, the board section 360 includes the planar surface 146 and the legs 362, 364 include the inclined surfaces 148, 150, respectively. The legs 362, 364 also include side surfaces 363, 365, respectively. In the illustrated embodiment, the leg 362 is shaped (e.g., bent) to define the inclined surface 148, the side surface 363, and a longitudinal segment 366. Likewise, the leg 364 is shaped (e.g., bent) to define the inclined surface 150, the side surface 365, and a longitudinal segment 368. The longitudinal segments 366, 368 extend inwardly toward each other and are sized and shaped to be inserted into the shell channels 352, 354, respectively. In an exemplary embodiment, the longitudinal segments 366, 368 may be inserted into the inlets 353, 355 (FIG. 2), respectively, of the corresponding shell channels 352, 354 as the housing shell 138 is advanced toward the base portion 140. The longitudinal segments 366, 368 may slide within the shell channels 352, 354, respectively, until the longitudinal segments 366, 368 engage a backstop 370 of the base portion 140.

The longitudinal segments 366, 368 may be bent inward relative to a remainder of the legs 362, 364, respectively. In the illustrated embodiment, the longitudinal segments 366, 368 are bent such that the longitudinal segment 366 engages one or more points along the sidewall 372 and one or more points along the sidewall 374. For example, the longitudinal segment 366 may be bent such that an angle $\theta_3$ formed between the longitudinal segment 366 and a remainder of the leg 362 is less than 90°. The multiple points of contact between the longitudinal segments 366, 368 and the base portion 140 may facilitate shielding the card connector 250 from EMI. In addition, the multiple points of contact between the longitudinal segments 366, 368 and the base portion 140 may four a frictional engagement that facilitates securing the housing shell 138 to the base portion 140.

Figure 5:
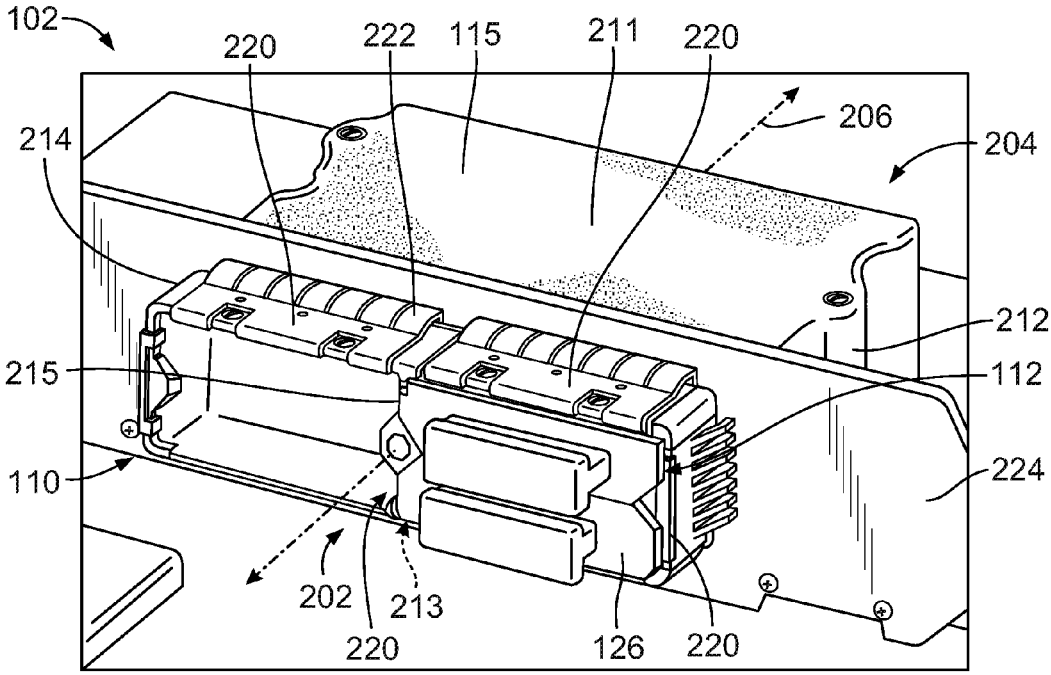
FIG. 5 is a perspective view of a receptacle assembly in accordance with one embodiment that may be used by the connector assembly of FIG. 1.

FIG. 5 is a perspective view of the receptacle assembly 102 formed in accordance with one embodiment. The receptacle assembly 102 (or the assembly housing 115) has a front end or face 202, a back end 204, and a longitudinal axis 206 extending therebetween. The longitudinal axis 206 may extend parallel to the insertion axis 191 (FIG. 1). The assembly housing 115 also has a plurality of housing sides 211-214 and an interior wall or divider 215 that extend along a longitudinal direction parallel to the longitudinal axis 206 between the front end 202 and the back end 204. In an exemplary embodiment, the assembly housing 115 is stamped and fowled from sheet material. However, the assembly housing 115 or portions thereof may be formed through other methods (e.g., molding).

Figure 6:
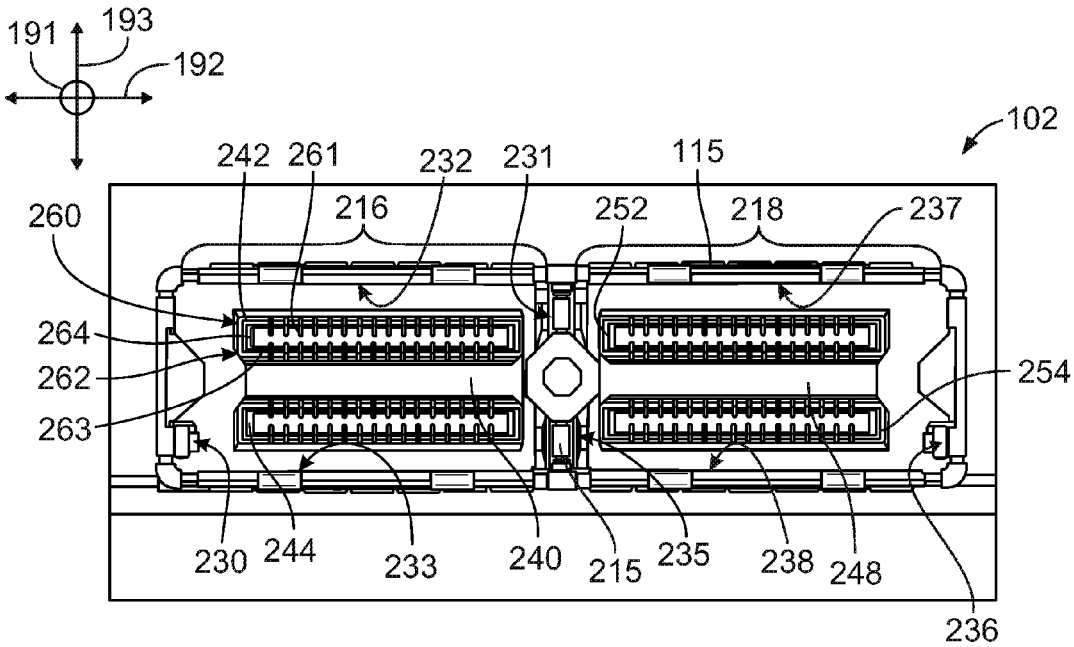
FIG. 6 is a front view of the receptacle assembly of FIG. 5.

The front end 202 includes the receiving ports 110, 112, which provide access to plug cavities 216, 218, respectively (shown in FIG. 6). Each of the plug cavities 216, 218 is sized and shaped to receive either of the plug connectors 105, 106 (FIG. 1) alone and a dust plug 126 or both of the plug connectors 105, 106 united as the plug assembly 108 (FIG. 1). As a pair, the plug cavities 216, 218 are configured to receive the plug connector 107 (FIG. 1). Each of the plug cavities 216, 218 is also configured to receive one or more of the dust plugs 126.

As shown in FIG. 5, the receptacle assembly 102 may have a plurality of ground clips 220 that engage corresponding edges of the housing sides 211-214 and the interior wall 215. The ground clips 220 may include external spring fingers 222 that extend away from the respective housing side. The spring fingers 222 are configured to engage, for example, a panel 224 to electrically ground the receptacle assembly 102.

FIG. 6 is a front view of the receptacle assembly 102 illustrating the plug cavities 216, 218 in greater detail. The plug cavity 216 is defined by a plurality of interior surfaces of the assembly housing 115 including interior surfaces 230-233. Likewise, the plug cavity 218 is defined by a plurality of interior surfaces of the assembly housing 115 including interior surfaces 235-238. The interior surfaces 230, 231 oppose each other with the plug cavity 216 extending therebetween, and the interior surfaces 235, 236 oppose each other with the plug cavity 218 extending therebetween. In the illustrated embodiment, the interior wall 215 includes the interior surfaces 231, 235. The interior wall 215 separates the plug cavities 216, 218.

The receptacle assembly 102 is configured to have a plurality of communication conductors that are positioned in the plug cavities 216, 218 a depth from the front end 202 (FIG. 5). As used herein, a "communication conductor" may include at least one of an electrical conductor or an optical conductor. For example, the electrical conductor may include an electrical contact or terminal, and the optical conductor may include an optical fiber end. The communication conductors are configured to engage corresponding plug connectors and establish a communicative connection therebetween.

In the illustrated embodiment, the communication conductors are electrical contacts. More specifically, the receptacle assembly 102 may include a receptacle connector 240 disposed in the plug cavity 216. The receptacle connector 240 may have a plurality of edge slots 242, 244 stacked relative to each other along the orientation axis 193. The receptacle assembly 102 may also include a receptacle connector 248 disposed in the plug cavity 218 that has a plurality of edge slots 252, 254 stacked relative to each other along the orientation axis 193.

Each of the edge slots 242, 244, 252, 254 may include opposing rows of electrical contacts (or communication conductors). For example, with specific reference to the edge slot 242, the edge slot 242 includes a first row 260 of electrical contacts 261 and a second row 262 of electrical contacts 263. The first and second rows 260, 262 extend parallel to the lateral axis 192. The first and second rows 260, 262 oppose each other with a spacing 264 therebetween. The spacing 264 is dimensioned to receive a card edge (not shown) from the plug connector 105 (FIG. 1), such as the card edge 256 (FIG. 2). For instance, the first row 260 of the electrical contacts 261 may engage a first side of the card edge and the second row 262 of the electrical contacts 263 may engage a second side of the card edge. In an exemplary embodiment, the electrical contacts 261, 263 include contact beams that extend lengthwise in a direction out of the page (e.g., along the insertion axis 191). When the card edge is inserted between the first and second rows 260, 262, the electrical contacts 261, 263 engage the corresponding side of the card edge and flex away from the opposing row.

However, other configurations of communication conductors may be used. For example, in one embodiment, the plug connector may include pin contacts that project parallel to the insertion axis 191 and are received by corresponding sockets in the receptacle assembly 102. Alternatively, the plug connector may include socket contacts and the receptacle assembly may include pin contacts. In other embodiments, the plug connector may include optical fiber ends that are configured to engage optical fiber ends in the receptacle assembly 102.

Figure 7:
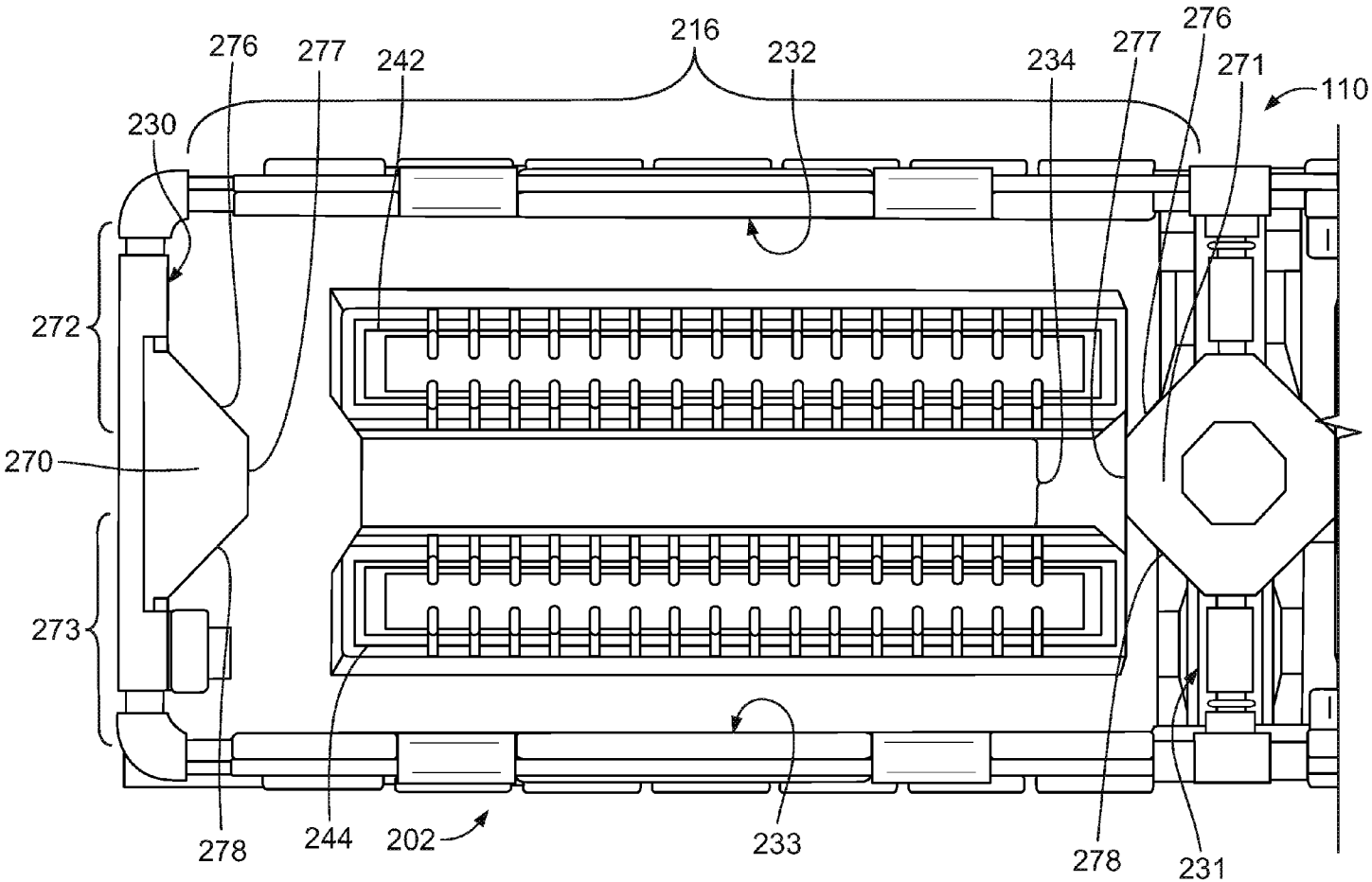
FIG. 7 is an enlarged front view of one receiving port of the receptacle assembly of FIG. 5.

FIG. 7 is an enlarged front view of the receiving port 110. Although the following is described with reference to the receiving port 110, the description may be similarly applied to the receiving port 112 (FIG. 1). As shown in FIG. 7, each of the interior surfaces 230, 231 may include a respective guide element 270, 271. The guide elements 270, 271 extend lengthwise in the longitudinal direction. In the illustrated embodiment, the guide elements 270, 271 are substantially flush with the front end 202 and extend therefrom into the plug cavity 216. However, in other embodiments, the guide elements 270, 271 may begin a depth within the plug cavity 216 and extend therefrom.

As shown, the guide elements 270, 271 are configured to generally set apart or divide a volume of the plug cavity 216 into separate passageways 272, 273. The passageway 272 includes the edge slot 242, and the passageway 273 includes the edge slot 244. Each of the guide elements 270, 271, is dimensioned to project away from the respective interior surface 230, 231 toward the other guide element. For example, each of the guide elements 270, 271 may include first and second engagement surfaces 276, 278 and a separation surface 277 that joins the first and second engagement surfaces 276, 278. The separation surfaces 277 are located a distance away from the respective interior surfaces 230, 231.

Each of the passageways 272, 273 is dimensioned to receive a plug connector, such as the plug connector 106 (FIG. 2). The guide elements 270, 271 direct each of the corresponding plug connectors as the plug connectors move along in the longitudinal direction until the leading ends engage the edge slots 242, 244. In the illustrated embodiment, although the passageways 272, 273 are set apart by the guide elements 270, 271, the passageways 272, 273 are in fluid communication from the receiving port 110 to the communication conductors at the edge slots 242, 244 (e.g., empty space separates the passageways 272, 273). For example, when one of the plug connectors is removed, the mating side of the other plug connector faces and extends along the empty passageway.

By way of example, the receiving port 110 and corresponding plug cavity 216 are dimensioned to receive the plug assembly 108 (FIG. 1), which includes the plug connectors 105, 106. The guide elements 270, 271 and the interior surfaces 230-232 define a space that is similar in size and shape to the plug connector 105. Likewise, the guide elements 270, 271 and the interior surfaces 230, 231, 233 define a space that is similar in size and shape to the plug connector 106. When the plug connectors 105, 106 are disposed in the plug cavity 216, a module seam 234 may exist between the plug connectors 105, 106. The module seam 234 may be configured, in part, by the separation surfaces 277 of the guide elements 270, 271. The EMI shield sections 122 (FIG. 3) of the plug connectors 105, 106 are configured to be located in the module seam 234.

The first engagement surfaces 276 of the guide elements 270, 271 are configured to engage portions of the plug connector 105. The second engagement surfaces 278 of the guide elements 270, 271 are configured to engage portions of the plug connector 106. For example, the inclined surface 150 (FIG. 3) of the plug connector 106 may slide along the second engagement surface 278 of the guide element 271. The EMI shield section 122 may engage the second engagement surface 278 of the guide element 271 as the plug connector 106 is advanced through the receiving port 110. More specifically, the spring finger 162 (FIG. 3) may engage and be deflected by the second engagement surface 278 of the guide element 271. The inclined surface 148 (FIG. 3) may slide along the second engagement surface 278 of the guide element 270.

Figure 8:
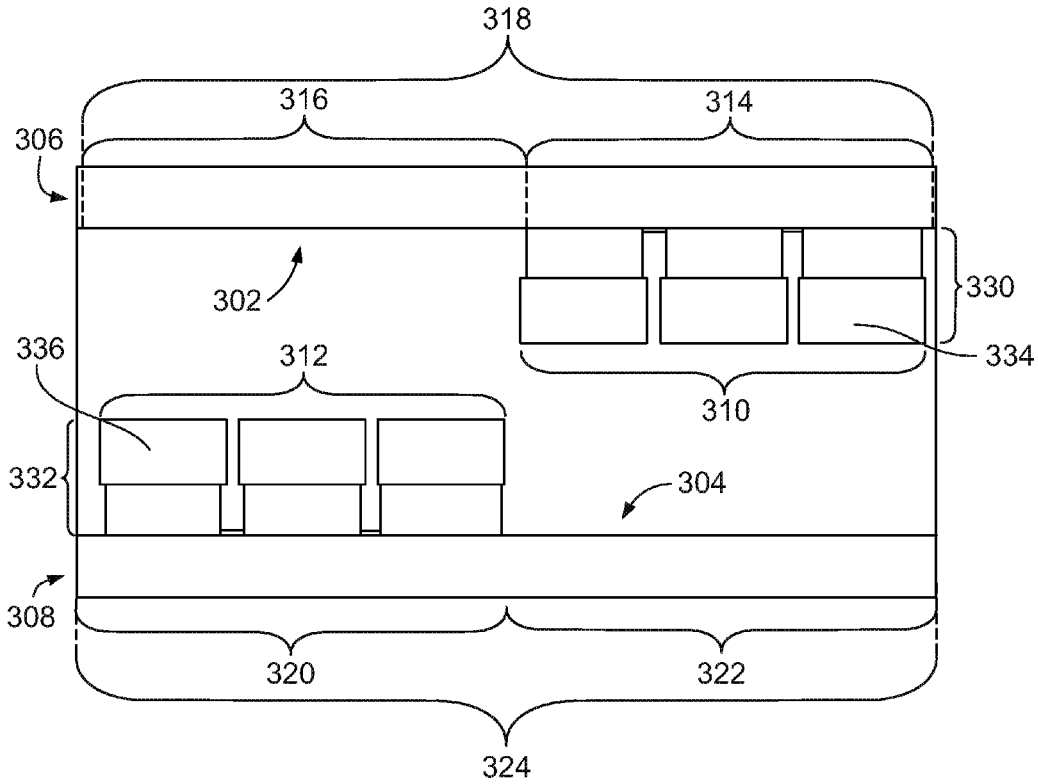
FIG. 8 is a schematic view of mating sides from separate plug connectors in which each of the mating sides has an electromagnetic interference (EMI) shield section.
Figure 9:
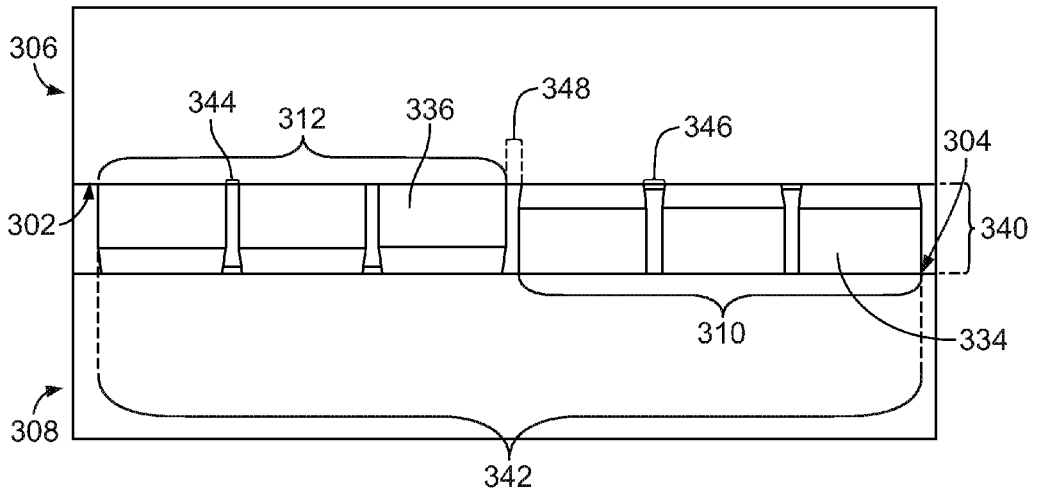
FIG. 9 is a schematic view of the mating sides illustrating a ground shield formed by the EMI shield sections when the plug connectors interface with each other.

FIGS. 8 and 9 are schematic front or end views of mating sides 302, 304 during a stacking operation. In the illustrated embodiment, each of the mating sides 302, 304 is part of a corresponding plug connector 306, 308. In alternative embodiments, one of the mating sides 302, 304 may be part of a dust plug, such as the dust plug 126 (FIG. 1). The plug connectors 306, 308 may be similar or identical to the plug connectors 105, 106 (FIG. 1). As shown in FIG. 8, the mating sides 302, 304 have EMI shield sections 310, 312, respectively, attached thereto. The mating side 302 includes an attachment area 314 and an exposed area 316. The attachment and exposed areas 314, 316 may be different portions of a common planar surface 318. Likewise, the mating side 304 includes an attachment area 320 and an exposed area 322 that may be different portions of a common planar surface 324.

As shown in FIG. 8, the EMI shield section 310 projects a distance or height 330 away from the mating side 302, and the EMI shield section 312 projects a distance or height 332 away from the mating side 304. The EMI shield sections 310, 312 may include spring fingers 334, 336, respectively, that project the distance 330, 332, respectively. The spring fingers 334, 336 may constitute resilient members that are configured to be deflected toward the respective mating side. FIG. 8 shows the EMI shield sections 310, 312 and respective spring fingers 334, 336 in unengaged or relaxed conditions.

FIG. 9 shows the EMI shield sections 310, 312 and the respective spring fingers 334, 336 in engaged conditions. By way of example, the plug connector 306 may be inserted into a plug cavity (not shown) to engage one or more communication conductors (not shown). After the plug connector 306 is inserted into the plug cavity and engaged to the communication conductors, the plug connector 308 may be inserted into the same plug cavity. As the plug connector 308 advances into the plug cavity, the mating side 302 may engage the EMI shield section 312 and the mating side 304 may engage the EMI shield section 310. More specifically, the spring fingers 334 may engage and be deflected by the exposed area 322 of the planar surface 324 (FIG. 8). The spring fingers 336 may engage and be deflected by the exposed area 316 of the planar surface 318 (FIG. 8). Due to the flexibility of the spring fingers 334, 336, the respective EMI shield sections 310, 312 may permit the plug connectors 306, 308 to slide alongside each other parallel to the plug axes (not shown) while the EMI shield sections 310, 312 are engaged to the mating sides 304, 302, respectively.

When both of the plug connectors 306, 308 are disposed in the plug cavity and communicatively engaged with the receptacle assembly (not shown), a module seam 340 may exist therebetween. The module seam 340 may be approximately equal to or less than the distances 330 and 332 (FIG. 8). The EMI shield sections 310, 312 are located in the module seam 340.

As shown in FIG. 9, the EMI shield sections 310, 312 may be dimensioned such that the EMI shield sections 310, 312 collectively form a ground shield or gasket 342. The EMI shield sections 310, 312 may be immediately adjacent to each other to form the ground shield 342. For example, adjacent spring fingers 336 may be spaced apart from each other by a finger gap 344, and adjacent spring fingers 334 may be spaced apart from each other by a finger gap 346. The gaps 344 and 346 may be approximately equal. Moreover, an end spring finger 336 of the EMI shield section 312 may be adjacent to and spaced apart from one of the spring fingers 334 by a section gap 348. The section gap 348 may be approximately equal to the finger gaps 344, 346.

The EMI shield sections 310, 312 are configured such that one of the plug connectors 306, 308 may be removed while the other plug connector is communicatively engaged to the receptacle assembly (not shown). More specifically, in the illustrated embodiment, each of the EMI shield sections 310, 312 is located on the respective mating side 302, 304 such that the plug connectors 306, 308 are permitted to be removed or withdrawn from the receptacle assembly one at a time without damaging the EMI shield sections 310, 312. The EMI shield section may slidably engage the opposing mating side when the plug connector is withdrawn.

Figure 10:
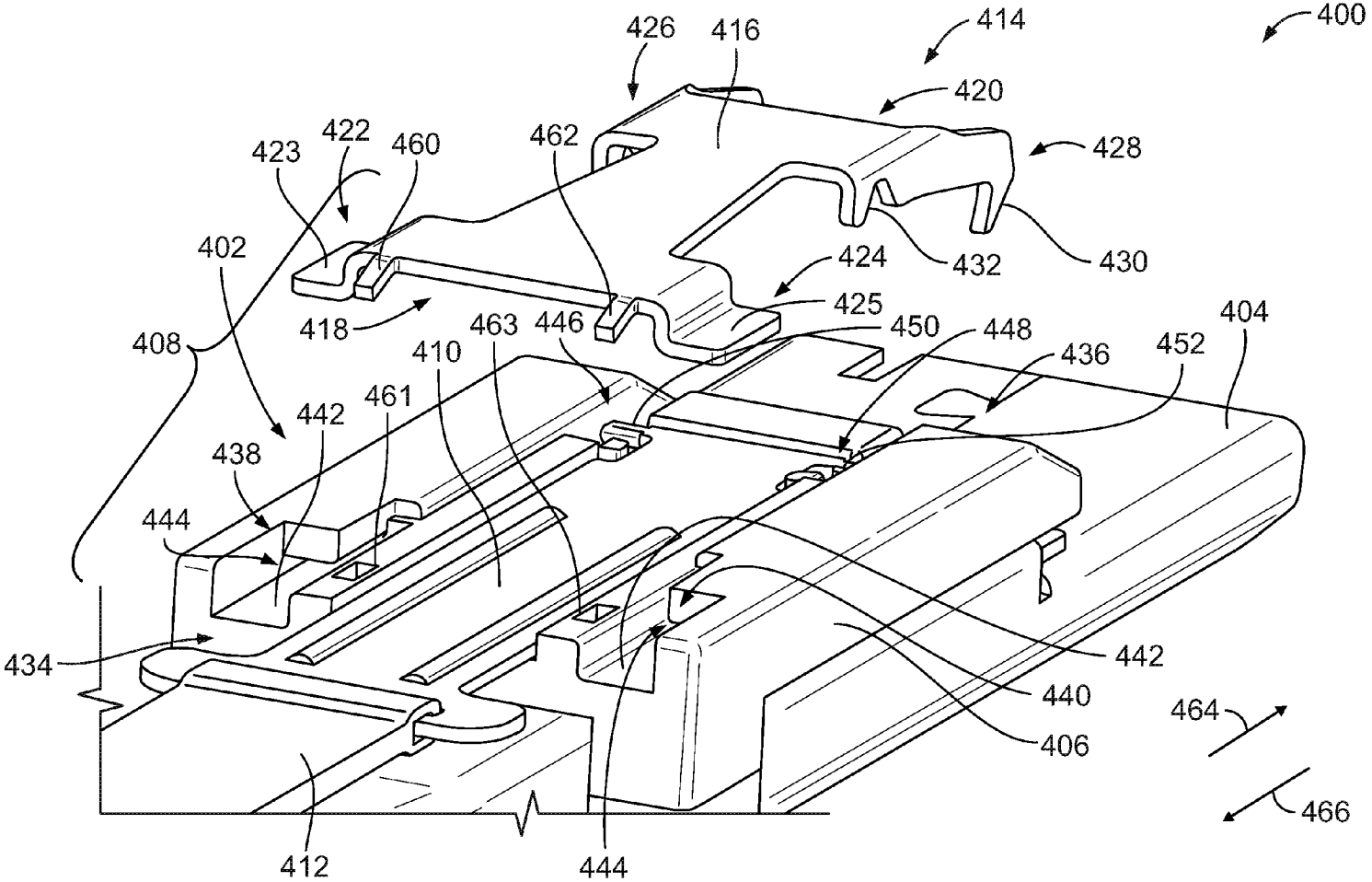
FIG. 10 shows an actuator plate before the actuator plate is mounted to a plug body of a plug connector formed in accordance with one embodiment.

FIG. 10 is a rear perspective view of a plug connector 400 formed in accordance with one embodiment. The plug connector 400 may be similar to the plug connector 105 (FIG. 1). For example, the plug connector 400 has a plug body 402 that includes a housing shell 404 and a base portion 406 secured together. FIG. 10 also shows a latch assembly 408 that may be used with one or more embodiments described herein. The latch assembly 408 includes a slider 410 and a pull-strap 412 that is coupled to the slider 410. The latch assembly 408 also includes an actuator plate 414. The actuator plate 414 and the slider 410 are configured to be mounted and movably coupled to the base portion 406.

As shown in FIG. 10, the actuator plate 414 has a plate body 416 that includes a back end 418 and a front end 420. The plate body 416 may be stamped and formed or, alternatively, molded to include various structural features. For example, the back end 418 may include base legs 422, 424 that project away from the plate body 416. The base legs 422, 424 include distal tabs 423, 425 that extend parallel to the plate body 416. The front end 420 of the plate body 416 also includes actuator arms 426, 428 that project therefrom. Each of the actuator arms 426, 428 is shaped to extend in a direction that is perpendicular or orthogonal to the plate body 416. In an exemplary embodiment, each of the actuator arms 426, 428 includes one or more edges that define a grip element 430 and a lift feature 432. The grip element 430 may be a projection or finger that is configured to grip or engage a portion of an assembly housing, such as the assembly housing 115 (FIG. 1). The lift feature 432 may be a recess or groove. Also shown in FIG. 10, the back end 418 of the plate body 416 includes latches 460, 462 that extend rearwardly away from the back end 418 of the plate body 416.

As shown in FIG. 10, the base portion 406 includes a loading end 434 and a grip end 436. The base portion 406 may be shaped to include slots, channels, recesses, and/or cavities that are configured to receive the above-described structural features of the actuator plate 414 when the actuator plate 414 is mounted onto the base portion 406. For example, the loading end 434 includes mounting channels 438, 440. Each of the mounting channels 438, 440 includes a tab-receiving space 442 and a loading slot 444. The tab-receiving spaces 442 are configured to receive the corresponding distal tabs 423, 425 when the actuator plate 414 is initially mounted to the base portion 406. The loading slots 444 of the channels 438, 440 are sized and shaped to receive the distal tabs 423, 425 when the actuator plate 414 is advanced in a loading direction (indicated by the arrow 464). As the actuator plate 414 is advanced in the loading direction 464, the latches 460, 462 slide along the base portion 406 and flex into (e.g., snap into) recesses 461, 463 of the base portion 406. When the latches 460, 462 are disposed within the recesses 461, 463, the latches 460, 462 operate to prevent the actuator plate 414 from being moved along the base portion 406 in a withdrawing direction 466, which is opposite the loading direction 464.

The grip end 436 of the base portion 406 may include arm slots 446 and 448 that are sized and shaped to receive the actuator arms 426, 428. As shown in FIG. 10, the slider 410 may include a substantially planar plate having pins or projections 450, 452 that extend in opposite lateral directions. The pins 450, 452 extend into the arm slots 446, 448, respectively. When the actuator arms 426, 428 are lowered into the arm slots 446, 448, the lift features 432 receive the respective pins 450, 452.

Figure 11:
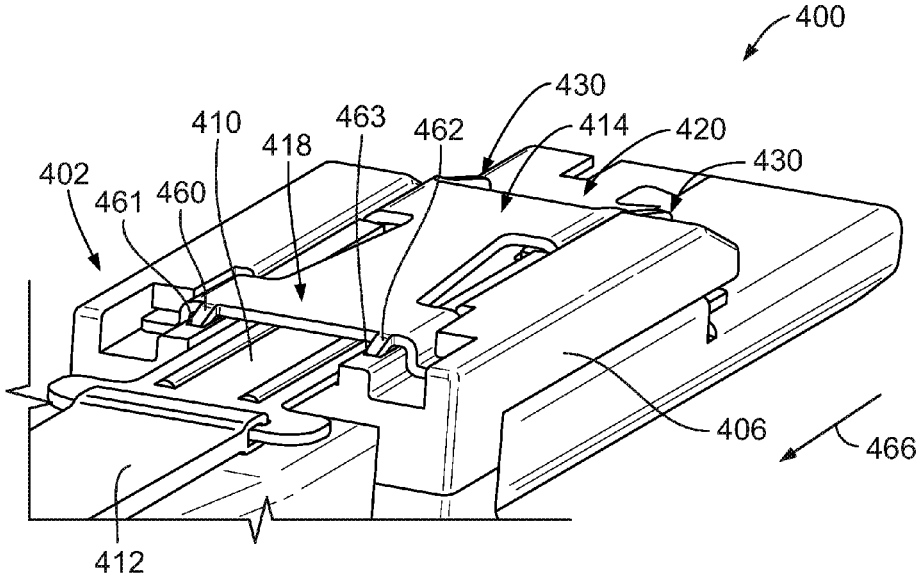
FIG. 11 shows the actuator plate mounted to the plug body of the plug connector of FIG. 10.

FIG. 11 shows the actuator plate 414 mounted to the base portion 406 of the plug body 402. In FIG. 11, the actuator plate 414 is in a closed or locked position. In the closed position, the grip elements 430 are configured to grip an assembly housing (not shown) to facilitate coupling the plug connector 400 to a receptacle assembly (not shown), such as the receptacle assembly 102 (FIG. 1). When the pull-strap 412 is pulled, the slider 410 moves in the withdrawing direction 466. As the slider 410 moves, the pins 450, 452 (FIG. 10) engage the lift features 432 (FIG. 10). However, the latches 460, 462 disposed in the recesses 461, 463, respectively, stop or prevent the actuator plate 414 from sliding in the withdrawing direction 466. At this time, each of the pins 450, 452 slides along the corresponding edge that defines the lift feature 432 thereby causing the front end 420 to move away from the base portion 406 while the back end 418 remains proximate to the base portion 406. In other words, the front end 420 may rotate away from the base portion 406 thereby decoupling the grip elements 430 from the assembly housing. The plug connector 400 may then be removed from the receptacle assembly.

Figure 12:
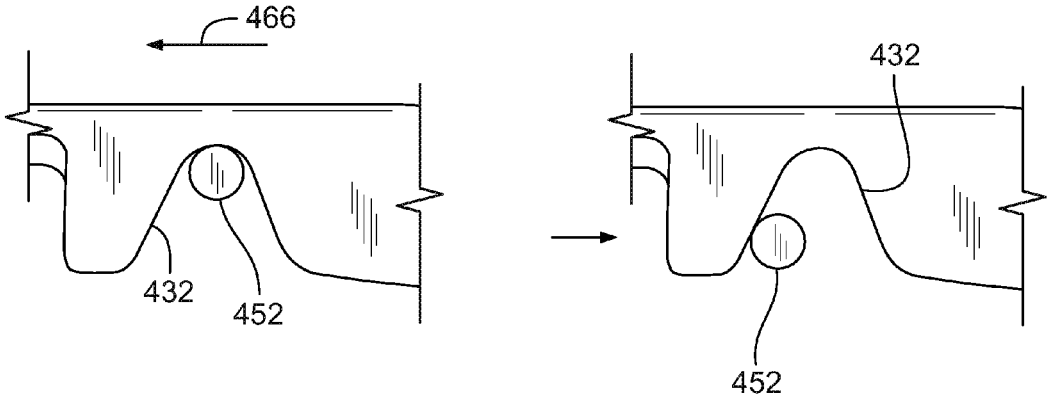
FIG. 12 is a schematic view illustrating a mechanism for lifting the actuator plate of FIG. 10.

FIG. 12 illustrates the mechanism for lifting the actuator plate 414 (FIG. 10) in greater detail. When the slider 410 (FIG. 10) moves in the withdrawing direction 466, the pin 452 engages the corresponding edge that defines the lift feature 432. The shape of the edge and the force of the slider 410, which is pulled in the withdrawing direction 466, causes the front end 420 (FIG. 10) of the actuator plate 414 to move away from the base portion 406 (FIG. 10).

As used herein, an element, step, or operation recited in the singular and proceeded with the word "a" or "an" should be understood as not excluding plural of said elements, steps, or operations unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A plug assembly comprising:

first and second plug connectors configured to be stacked with respect to each other, each of the first and second plug connectors having:

leading and trailing ends and a plug axis extending therebetween;

a mating side that extends between the leading and trailing ends along the plug axis, the mating side including an attachment area and an exposed area that are laterally adjacent to each other; and an electromagnetic interference (EMI) shield section coupled to the mating side at the attachment area;

wherein the mating sides of the first and second plug connectors interface with each other when the first and second plug connectors are stacked with respect to each other, the EMI shield section of the first plug connector engaging the mating side of the second plug connector at the exposed area of the mating side, the EMI shield section of the second plug connector engaging the mating side of the first plug connector at the exposed area of the mating side.

2. The plug assembly of claim 1, wherein the EMI shield sections of the first and second plug connectors permit the first and second plug connectors to slide alongside each other parallel to the plug axes while the EMI shield sections are engaged to the mating sides.

3. The plug assembly of claim 1, wherein the first and second plug connectors have identical structures such that the EMI shield sections are positioned immediately adjacent to each other when one of the first or second plug connectors is inverted relative to the other of the first or second plug connectors and the mating sides of the first and second plug connectors interface with each other.

4. The plug assembly of claim 1, wherein at least one of the EMI shield sections of the first or second plug connectors includes a resilient member that projects away from the corresponding mating side, the resilient member being deflected toward the corresponding mating side when engaged by the mating side of the other plug connector.

5. The plug assembly of claim 1, wherein each of the first and second plug connectors has first and second longitudinal sides that extend along the corresponding plug axis and a plug width measured between the first and second longitudinal sides, each of the EMI shield sections of the first and second plug connectors having a section width that is less than the plug width.

6. The plug assembly of claim 1, wherein the exposed and attachment areas of the first plug connector are portions of a common planar surface and the exposed and attachment areas of the second plug connector are portions of a common planar surface, the planar surfaces of the first and second plug connectors extending parallel to each other and defining a module seam therebetween when the first and second plug connectors interface with each other, the EMI shield sections being positioned in the module seam.

7. A plug connector comprising:

a plug body having leading and trailing ends and a plug axis extending therebetween, the plug body including a plurality of sides that extend between the leading and trailing ends along the plug axis, the plurality of sides including opposite first and second longitudinal sides and a mating side that extends between the first and second longitudinal sides, wherein the mating side includes an attachment area and an exposed area that are laterally adjacent to each other between the first and second longitudinal sides; and an electromagnetic interference (EMI) shield section coupled to the mating side at the attachment area, wherein the exposed area of the mating side is electrically conductive and configured to engage a different EMI element.

8. The plug connector of claim 7, wherein the EMI shield section includes a resilient member that projects away from the mating side, the resilient member being deflected toward the mating side when engaged by a component that moves relatively along the mating side in a direction parallel to the plug axis.

9. The plug connector of claim 8, wherein the resilient member has a curved contour that extends away from the mating side and curves back toward the mating side.

10. The plug connector of claim 7, wherein the EMI shield section includes at least one spring finger.

11. The plug connector of claim 7, wherein the plug body has a plug width measured between the first and second longitudinal sides, the EMI shield section having a section width that is less than the plug width.

12. The plug connector of claim 11, wherein the EMI shield section is dimensioned to be not greater than about half the plug width.

13. The plug connector of claim 7, wherein the exposed area and the attachment area are portions of a common planar surface.

14. The plug connector of claim 7, further comprising a card connector having a card edge with contacts thereon, the card edge being located proximate to the leading end.

15. The plug connector of claim 7, wherein the plug connector includes a base portion and a housing shell, the base portion including first and second shell channels that extend parallel to the plug axis, the housing shell including first and second longitudinal segments that are inserted into the first and second shell channels, respectively.

16. A receptacle assembly comprising:

an assembly housing having front and back ends and a longitudinal axis extending therebetween, the assembly housing including a plug cavity having a receiving port at the front end, the plug cavity being defined by a pair of interior surfaces of the assembly housing that oppose each other, each of the interior surfaces including a guide element that extends along the longitudinal axis, the guide elements generally dividing a volume of the plug cavity into separate first and second passageways; and first and second communication conductors disposed in the plug cavity, wherein the receiving port is configured to receive first and second plug connectors within the first and second passageways, respectively, the guide elements guiding the first and second plug connectors along the longitudinal axis to engage the first and second communication conductors, respectively.

17. The receptacle assembly of claim 16, wherein the first and second passageways are in fluid communication from the receiving port to the first and second communication conductors.

18. The receptacle assembly of claim 16, wherein the guide elements project toward each other.

19. The receptacle assembly of claim 16, wherein each of the first and second communication conductors is part of a corresponding edge slot.

20. The receptacle assembly of claim 16, wherein each of the first and second communication conductors includes at least one electrical contact.

* * * * *